US010620568B2

(12) United States Patent
Tanaka et al.

(10) Patent No.: US 10,620,568 B2
(45) Date of Patent: Apr. 14, 2020

(54) DEVELOPING DEVICE HAVING MAGNETIC FIELD GENERATING MEMBERS, IMAGE FORMING APPARATUS AND CARTRIDGE

(71) Applicant: CANON KABUSHIKI KAISHA, Tokyo (JP)

(72) Inventors: Hiroki Tanaka, Kawasaki (JP); Motonari Ito, Suntou-gun (JP); Hideo Kihara, Yokohama (JP); Akihisa Matsukawa, Fuchu (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/381,233

(22) Filed: Apr. 11, 2019

(65) Prior Publication Data

US 2019/0317429 A1 Oct. 17, 2019

(30) Foreign Application Priority Data

Apr. 11, 2018 (JP) ..... 2018-075986

(51) Int. Cl.
*G03G 15/08* (2006.01)

(52) U.S. Cl.
CPC ..... *G03G 15/0889* (2013.01); *G03G 15/0822* (2013.01); *G03G 2215/0802* (2013.01); *G03G 2215/085* (2013.01)

(58) Field of Classification Search
CPC ..... G03G 15/0889; G03G 15/0822; G03G 15/0877; G03G 2215/0802; G03G 2215/085
USPC ..... 399/254, 258, 262, 263, 267, 277
See application file for complete search history.

(56) References Cited

U.S. PATENT DOCUMENTS 4,960,069 A * 10/1990 Kaieda ..... G03G 15/0822 399/255
5,768,666 A * 6/1998 Ito ..... G03G 15/0822 399/260
6,035,169 A * 3/2000 Miyake ..... G03G 15/0808 399/258
6,415,125 B1 * 7/2002 Yamamoto ..... G03G 15/0822 399/254
7,233,758 B2 6/2007 Osada et al.
8,150,301 B2 4/2012 Adachi et al.
8,861,990 B2 10/2014 Watanabe et al.
(Continued)

FOREIGN PATENT DOCUMENTS

JP 07199628 A * 8/1995
JP 2005-173485 A 6/2005
(Continued)

*Primary Examiner* — Robert B Beatty
(74) *Attorney, Agent, or Firm* — Venable LLP

(57) ABSTRACT

A developing device includes a rotatable sleeve for carrying a developer including a magnetic material to develop a latent image on an image bearing member, a developer chamber, a rotatable stirring member provided inside the chamber to stir the developer while being in contact with at least a part of an inner surface of the chamber and a magnet generating a magnetic field in at least a part of a contact region between the stirring member and the inner surface. A magnetic flux density of the magnetic field at a first position in the contact region generated by the magnet is different from that in a second position which is adjacent to the first position in a rotational axis direction of the sleeve.

20 Claims, 9 Drawing Sheets

(56) References Cited

U.S. PATENT DOCUMENTS

| | | | | |
|---|---|---|---|---|
| 9,541,857 | B2 | 1/2017 | Adachi et al. | |
| 9,835,973 | B2 | 12/2017 | Goto et al. | |
| 9,904,202 | B2 | 2/2018 | Matsukawa et al. | |
| 9,946,189 | B2 | 4/2018 | Adachi et al. | |
| 9,977,368 | B2 | 5/2018 | Tanaka et al. | |
| 10,281,838 | B2 | 5/2019 | Adachi et al. | |
| 2009/0175659 | A1* | 7/2009 | Sheen | G03G 15/0893 399/256 |
| 2010/0074655 | A1* | 3/2010 | Morimoto | G03G 15/09 399/254 |
| 2013/0039670 | A1* | 2/2013 | Hosoya | G03G 15/0889 399/27 |
| 2018/0188667 | A1 | 7/2018 | Adachi et al. | |

FOREIGN PATENT DOCUMENTS

| | | | | |
|---|---|---|---|---|
| JP | 2009288363 | A | * | 12/2009 |
| JP | 2011-150122 | A | | 8/2011 |
| JP | 2011150124 | A | * | 8/2011 |
| JP | 2015079271 | A | * | 4/2015 |

* cited by examiner

DEVELOPING DEVICE HAVING MAGNETIC FIELD GENERATING MEMBERS, IMAGE FORMING APPARATUS AND CARTRIDGE

FIELD OF THE INVENTION AND RELATED ART

The present invention relates to a developing device used by an image forming apparatus such as an electrophotographic copying machine, an electrophotographic printer, and the like. It relates also to an image forming apparatus, and a cartridge used by an image forming apparatus.

Magnetic single component developer has been widely used as developer for an image forming apparatus. Magnetic single component developer can be supplied to, or held on, the surface of a developer bearing member by the magnetic force from a magnetic roller in a developer bearing member. Further, magnetic single component developer makes it possible, in coordination of the magnetic force from the magnet, to prevent the problem that an unsatisfactory image, such as a foggy image, is generated by the transfer of developer onto the developer-free portions of an image, in the developing portion of the developing device.

A stirring member having a sheet, such as the one disclosed in Patent Document 1, has been widely used to convey developer from the developer storage chamber of a developing device to the developer bearing member of the developing device. A sheet-like stirring member is flexible. In terms of the direction perpendicular to the rotational direction of the stirring member, its dimension is such that it could reach beyond the bottom wall of the developer storage chamber by a preset distance. Therefore, as it is rotated, it is flexed by the bottom wall of the developer storage chamber, being enabled to deliver the developer in the developer storage chamber to the develop bearing member, without leaving any developer behind.

Developer such as the magnetic single component developer described above is subjected to the pressure from a regulating member for regulating in thickness the developer layer on a developer bearing member, and/or the pressure from an image bearing member, throughout its life span. Therefore, the external additives of developer, which are for controlling developer in shape and chargeability, gradually reduce throughout the developer life span. That is, developer gradually deteriorates. Developer deterioration is one of the causes of the formation of an unsatisfactory image such as a foggy image. Thus, various methods have been developed. For example, according to Japanese Laid-open Patent Application No. 2005-173485, the developing device is provided with a stirring member comprising a shaft which extends in parallel to the rotational axis of the developer bearing member (perpendicular to recording medium conveyance direction), and a stirring sheet. Thus, the developer in the developer storage chamber, and that in the development chamber, are made to circulate by the stirring member to deter developer deterioration.

However, the pressure applied to the body of developer in a developing device, by a member for regulating the developer layer on the developer bearing member, and the pressure applied by the developer by an image bearing member, are not uniform in terms of the direction parallel to the rotational axis of the developer bearing member. Also in terms of the direction parallel to the rotational axis of the developer bearing member, a developing device (developer bearing member) is not uniform in the amount by which developer is consumed therefrom by printing. Moreover, it is difficult to circulate the developer in the abovementioned direction with the use of a sheet-like stirring member. Therefore, as a developing device, in particular, a developing device (development cassette) which is substantial in life span, increases in the cumulative length of its usage, the developer therein becomes nonuniform in the degree of deterioration in terms of the direction parallel to the rotational axis of the developer bearing member, toward the end of its life span, causing sometimes an image forming apparatus to output images which suffer from defects, the locations of which correspond to specific portions of the image bearing member in terms of the direction parallel to the rotational axis of the developer bearing member.

SUMMARY OF THE INVENTION

Thus, the primary object of the present invention is to provide a developing device, an image forming apparatus, and a cartridge, which can prevent the occurrence of the image defects attributable to the nonuniformity of the magnetic developer in terms of the direction parallel to the developer bearing member.

According to an aspect of the present invention, there is provided a developing device comprising a rotatable developer carrying member configured to carry a developer comprising a magnetic material to develop a latent image formed on an image bearing member; a developer accommodating chamber configured to accommodate the developer to be supplied to said developer carrying member; and a rotatable stirring member provided inside said developer accommodating chamber configured to stir the developer while being in contact with at least a part of an inner surface of said developer accommodating chamber; a magnetic field generating member generating a magnetic field in at lease a part of a contact region where said stirring member contacts said inner surface, wherein a magnetic flux density of the magnetic field at a first position in the contact region generated by said magnetic field generating member is different from that in a second position which is adjacent to the first position in a rotational axis direction of said developer carrying member.

According to another aspect of the present invention, there is provided an image forming apparatus comprising a developing device; a rotatable developer carrying member configured to carry a developer comprising a magnetic material to develop a latent image formed on an image bearing member; a developer accommodating chamber configured to accommodate the developer to be supplied to said developer carrying member; a rotatable stirring member provided inside said developer accommodating chamber configured to stir the developer while being in contact with at least a part of an inner surface of said developer accommodating chamber; and a magnetic field generating member generating a magnetic field in at lease a part of a contact region where said stirring member contacts said inner surface, wherein a magnetic flux density of the magnetic field at a first position in the contact region generated by said magnetic field generating member is different from that in a second position which is adjacent to the first position in a rotational axis direction of said developer carrying member.

According to a further aspect of the present invention, there is provided a cartridge detachably mountable to a main assembly of an image forming apparatus, said cartridge comprising a rotatable developer carrying member configured to carry a developer comprising a magnetic material to develop a latent image formed on an image bearing member; a developer accommodating chamber configured to accommodate the developer to be supplied to said developer carrying member; a rotatable stirring member provided inside said developer accommodating chamber configured to stir the developer while being in contact with at least a part of an inner surface of said developer accommodating chamber; and a magnetic field generating member generating a magnetic field in at lease a part of a contact region where said stirring member contacts said inner surface, wherein a magnetic flux density of the magnetic field at a first position in the contact region generated by said magnetic field generating member is different from that in a second position which is adjacent to the first position in a rotational axis direction of said developer carrying member.

Further features of the present invention will become apparent from the following description of exemplary embodiments with reference to the attached drawings.

BRIEF DESCRIPTION OF THE DRAWINGS

Parts (a), (b) and (c) of FIG. 1 are schematic sectional views of the developing device in the first embodiment of the present invention, an arrangement view (which shows positioning of magnetic field generating means) of the bottom wall of the developing device, and a graph which shows the magnetic flux density distribution, respectively.

Figure 3:
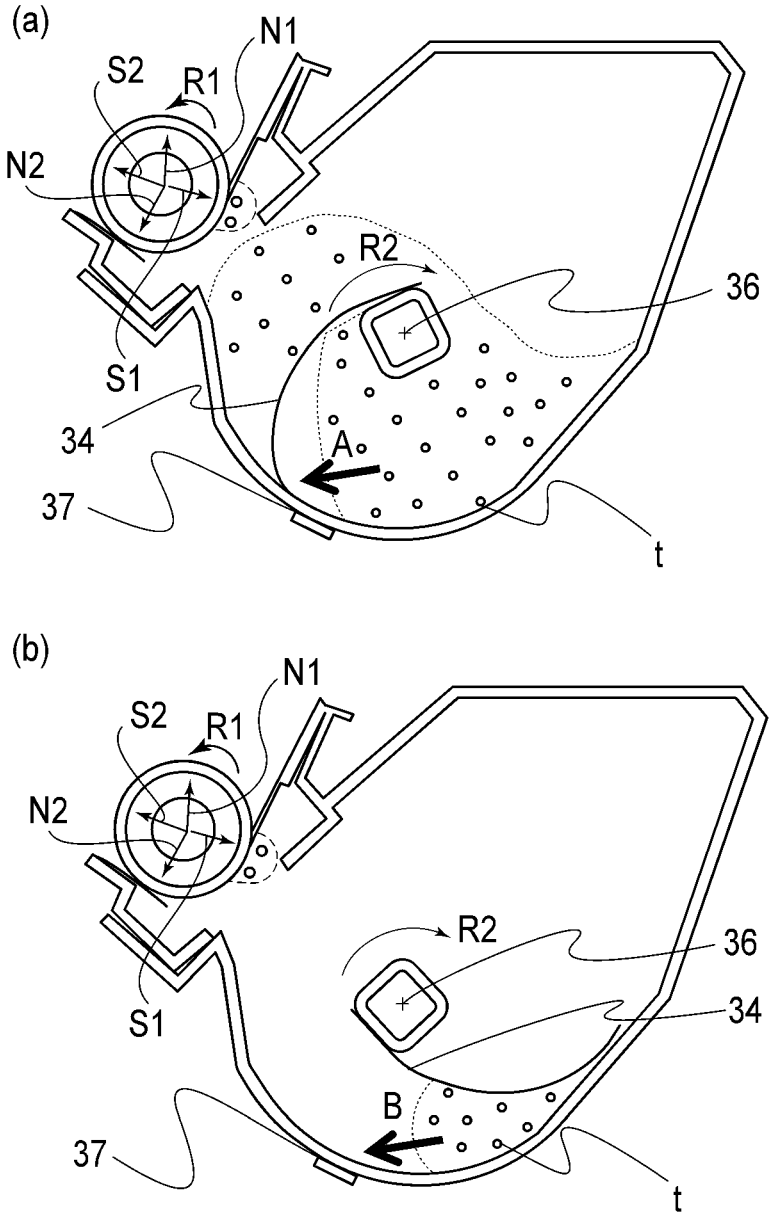

Parts (a) and (b) of FIG. 3 are schematic sectional views of the developing device in the first embodiment, which are for showing the toner movement caused by the stirring sheet of the developing device when a substantial amount of toner is in the developing device, and when only a small amount of toner remains in the apparatus, respectively.

Figure 4:
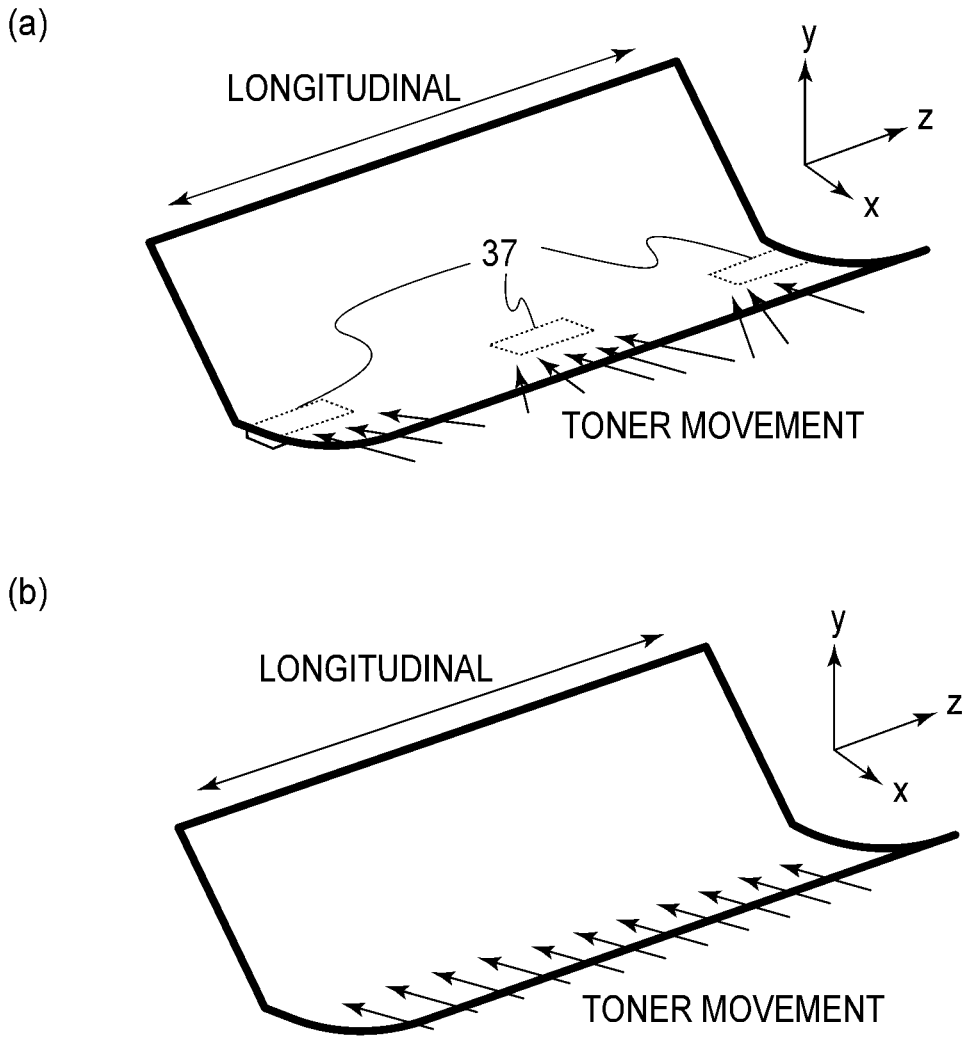

Parts (a) and (b) of FIG. 4 are a combination of an arrangement view of the bottom portion of the developer storage chamber having magnetic field generating means, and that having no magnetic field generating means, which is for comparing the toner movement which occurs when there are magnetic field generating means, and that when not.

Figure 5:
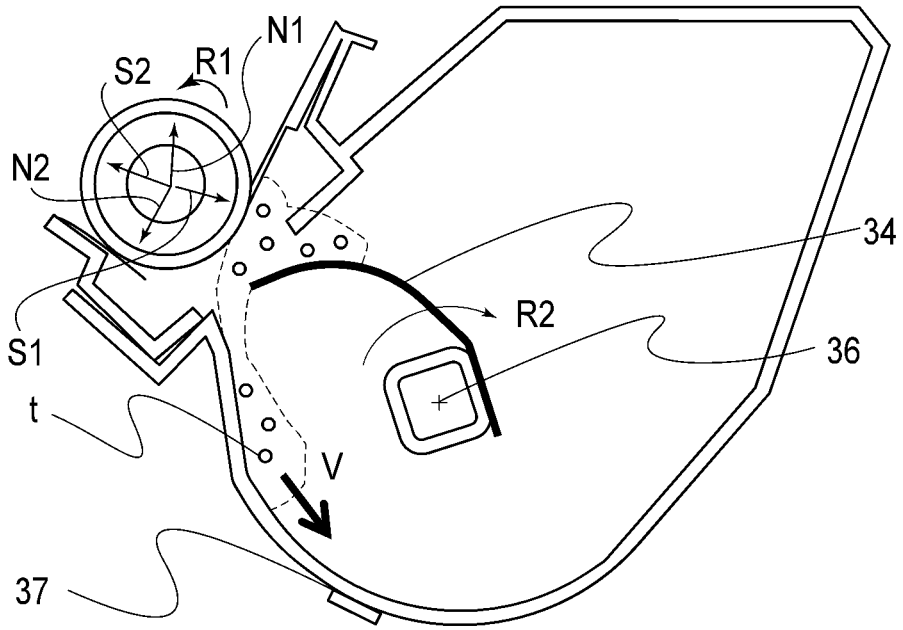

FIG. 5 is a schematic sectional view of the developing device in the first embodiment, which is for showing the toner movement which is opposite in direction from the rotational direction of the stirring sheet.

Figure 6:
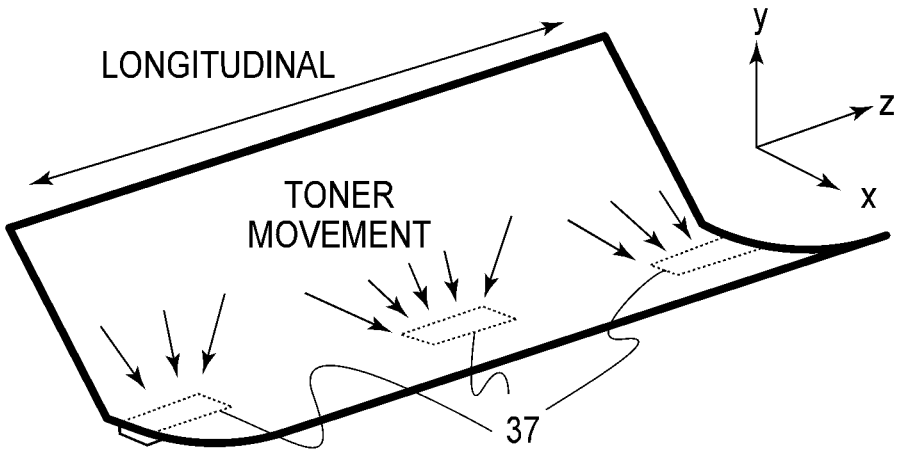

FIG. 6 is a schematic arrangement view of the bottom portion of the developer storage portion of the developing device, which is for showing the toner movement in the direction parallel to the rotational axis of the developer bearing member, which occurs in the developer storage chamber having magnetic field generating means.

Figure 7:
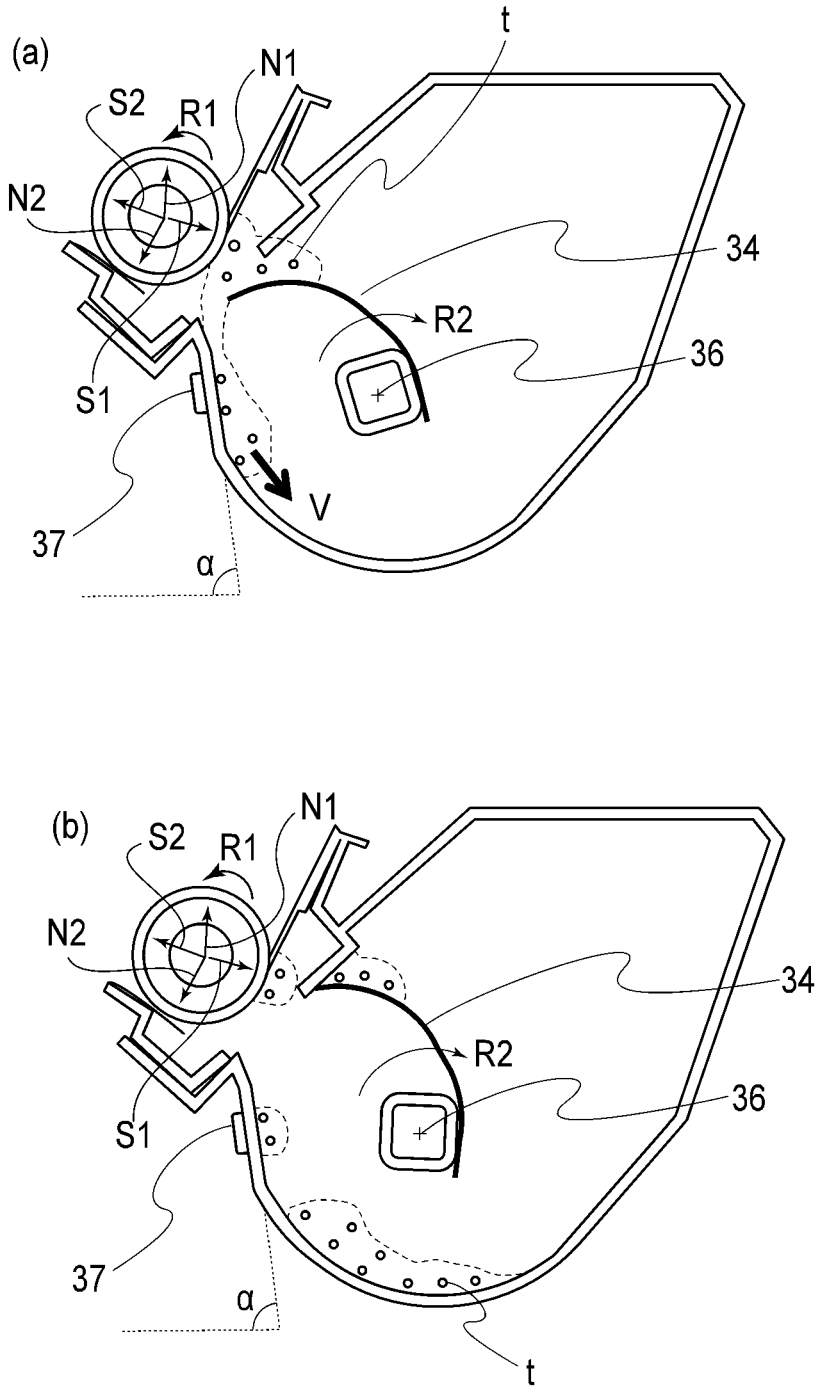

Part (a) of FIG. 7 is a schematic sectional views of the developing device in the second embodiment of the present invention, which shows the toner movement which occurs in the direction indicated by an arrow mark V, while the stirring sheet 34 separates from the inward surface of the toner container, and comes into contact with the inward surface for the second time, and part (b) of FIG. 7 is a schematic sectional view of the developing device, which shows the toner attracted to the inward surface of the toner container 301 by the magnetic force from the magnetic field generating means 37.

Figure 8:
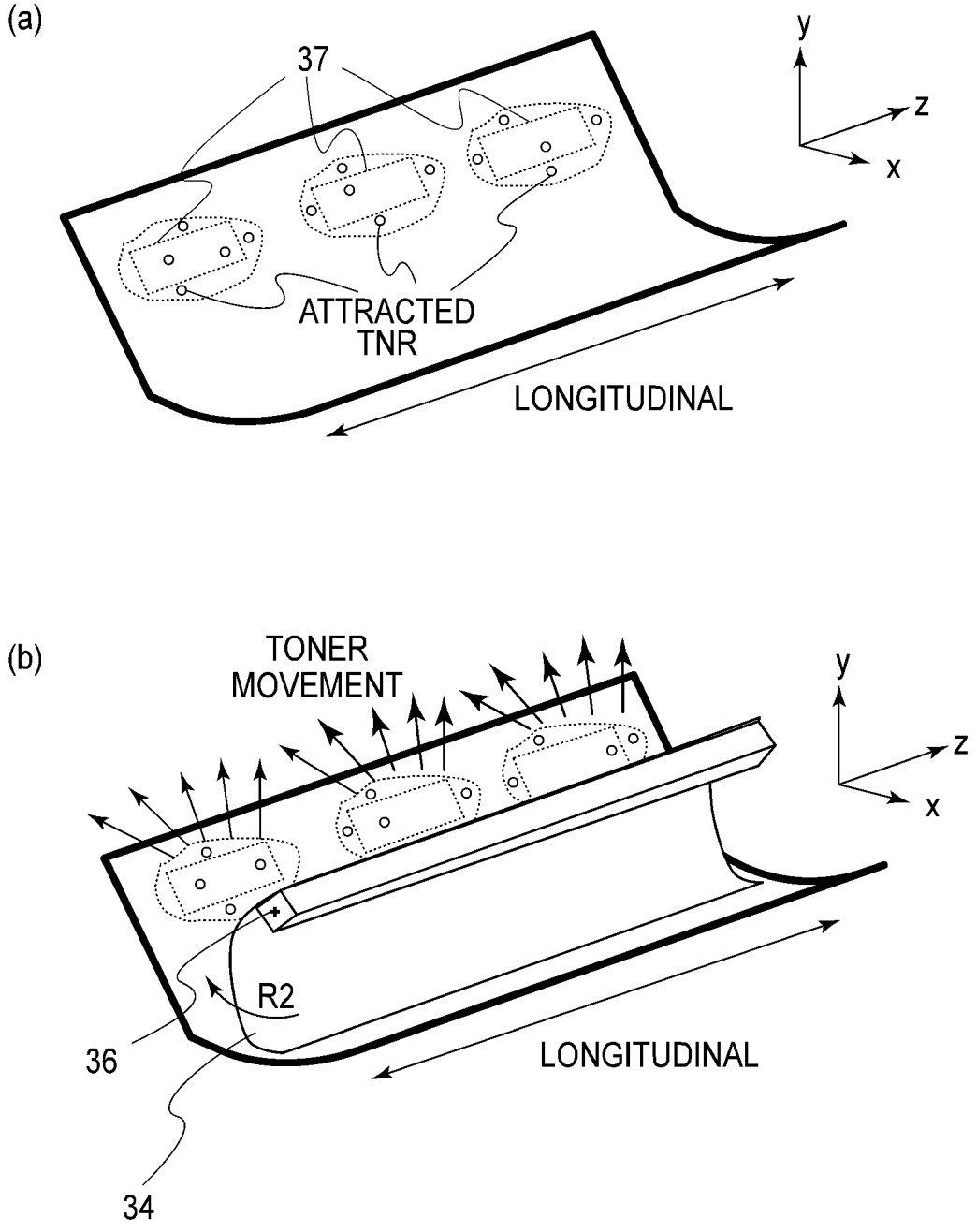

Part (a) of FIG. 8 is an arrangement view of the bottom portion of the toner storage portion of the developing device, which shows the state of the toner, shown in part (b) of FIG. 7, attracted to the magnetic field generating means aligned in the direction parallel to the rotational axis of the developer bearing member, and part (b) of FIG. 8 is a schematic arrangement view of the bottom portion of the toner storage portion of the developing device, which shows the toner movement which occurs in the direction parallel to the rotational axis of the developer bearing member as the stirring sheet 34 reaches the toner held to the bottom portion by the magnetic force from the magnetic field generating means, for the second time.

Figure 9:
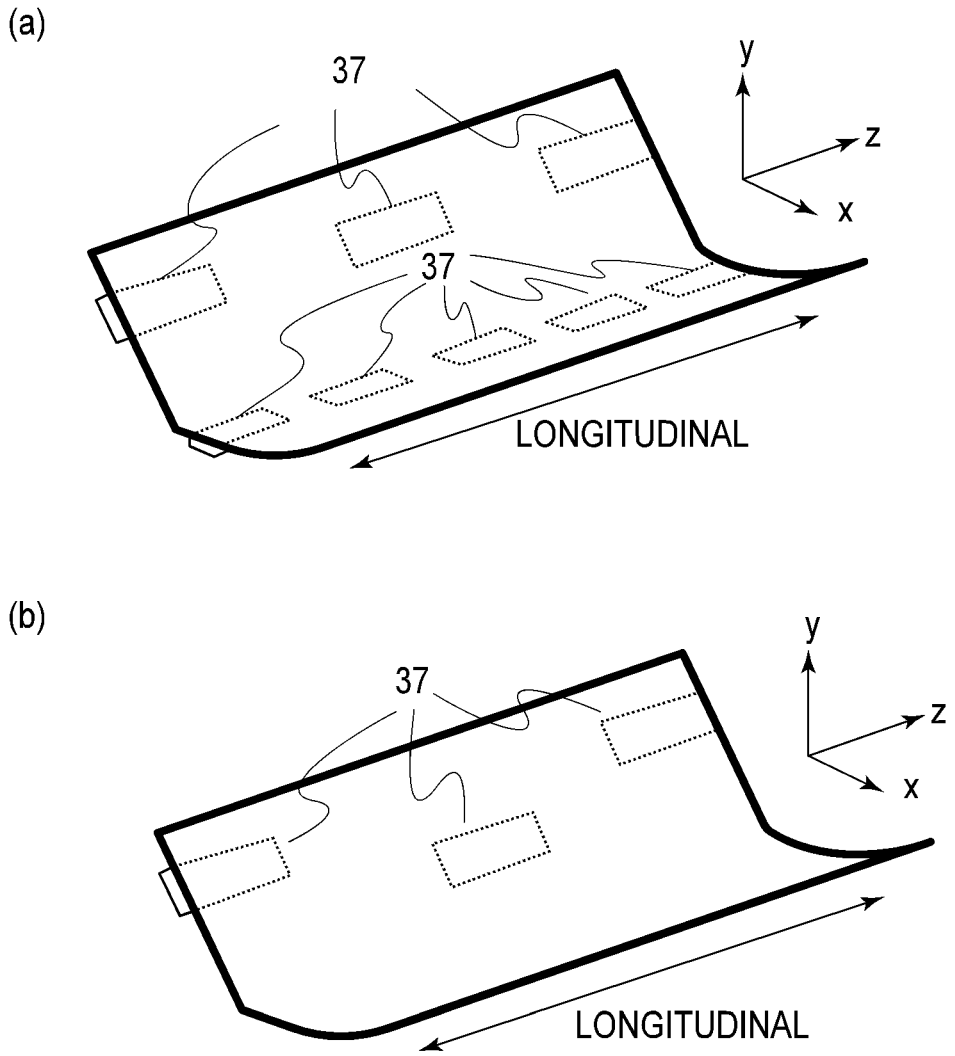

Part (a) of FIG. 9 is a schematic arrangement view of the bottom portion of the toner storage portion of the developing device, which is provided with two or more magnetic field generating means aligned in the direction parallel to the rotational axis of the developer bearing member, and part (b) of FIG. 9 is a schematic arrangement view of the bottom portion of the toner storage portion, which has two or more magnetic field generating means distributed in the rotational direction of the stirring sheet.

DESCRIPTION OF THE EMBODIMENTS

Hereinafter, a few preferred embodiments of the present invention are described with reference to appended drawings.

Embodiment 1

The embodiments of the present invention, which are going to be described next, are for exemplarily describing the present invention. That is, the measurements, materials, and shapes of the structural components of the developing devices, image forming apparatuses, and cassettes, in the following embodiments, and their positioning relative to each other, are not intended to limit the present invention in scope, unless specifically noted.

(Image Forming Apparatus and Image Formation Process)

Figure 2:
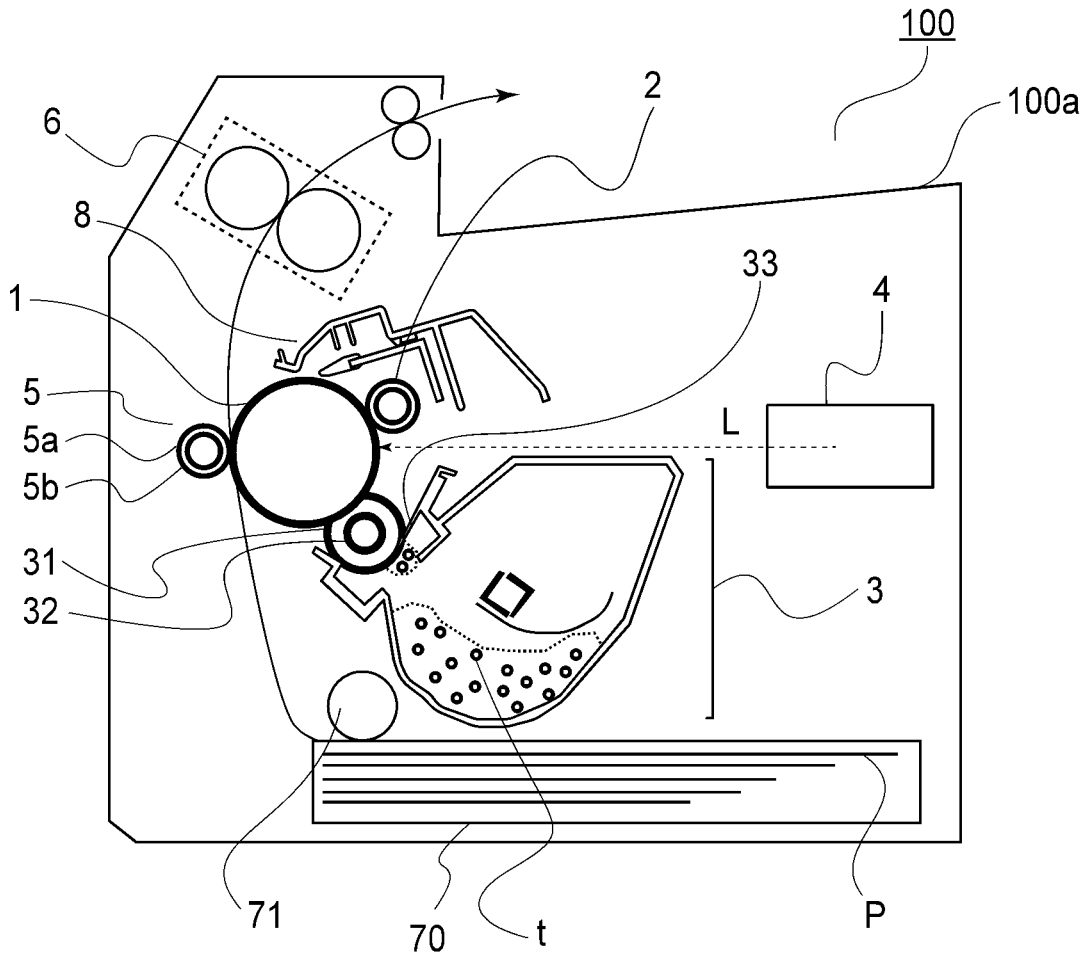
FIG. 2 is a schematic sectional view of the image forming apparatus which has a developing device which is in accordance with the present invention (first embodiment).

FIG. 2 is a schematic sectional view of an image forming apparatus having a developing device 3 in this embodiment of the present invention. This image forming apparatus is a laser printer which uses an electrophotographic process. The developing device 3 is removably installable in the apparatus main assembly 100*a* of the image forming apparatus 100. As a printing start signal is inputted into the controller of the image forming apparatus 100*a*, the controller makes the image forming apparatus 100 start an image forming operation; with preset timings, various driving portions of the apparatus 100 begin to move, and voltages begin to be applied.

A photosensitive drum 1 is a rotationally drivable image bearing member. It is uniformly charged by a charge roller 2. As the photosensitive drum 1 is uniformly charged, it is exposed by a beam L of laser light from a scanner unit 4 as an exposing means. As a result, an electrostatic latent image (latent image) is effected on the peripheral surface of the photosensitive drum 1 (image bearing member). This electrostatic latent image is supplied with toner by the developing device 3. As a result, the electrostatic latent image is developed into a visible image formed of toner (which hereafter will be referred to as toner image).

In this embodiment, toner is such developer that contains magnetic substance. More specifically, it is the so-called magnetic single component developer. Toner is negative in the normal polarity. It is no less than 3 μm, and no more than 8 μm, in particle diameter. The magnetic substance it contains is iron oxide. The magnetic substance content in the toner is no less than 60%, and no more than 90%, in weight ratio.

As for sheets P of recording medium, they are fed one by one into the apparatus main assembly 100*a* from a recording medium storage portion 70, while being separated from the rest, by a recording medium supplying unit 71. In synchronism with the formation of a toner image on the photosensitive drum 1, each sheet P of recording medium is delivered to the interface (transferring portion) between the transfer roller 5 (which is a transferring means), and the photosensitive drum 1.

After the electrostatic latent image is developed into a visible image, or a toner image, the toner image is transferred onto a sheet P of recording medium by the bias applied to the transfer roller 5. After the transfer of the toner image onto the sheet P, the sheet P is conveyed to a fixing means 6. In the fixing means 6, the unfixed toner image on the sheet P is fixed to the sheet P by heat and pressure. Thereafter, the sheet P is discharged out of the apparatus main assembly 100*a* by discharge rollers or the like.

As for the transfer residual toner, that is, the toner remaining on the peripheral surface of the photosensitive drum 1 after the primary transfer of the toner image, it is removed by a cleaning apparatus to prepare the photosensitive drum 1 for the next image formation process.

(Developing Device)

Figure 1:
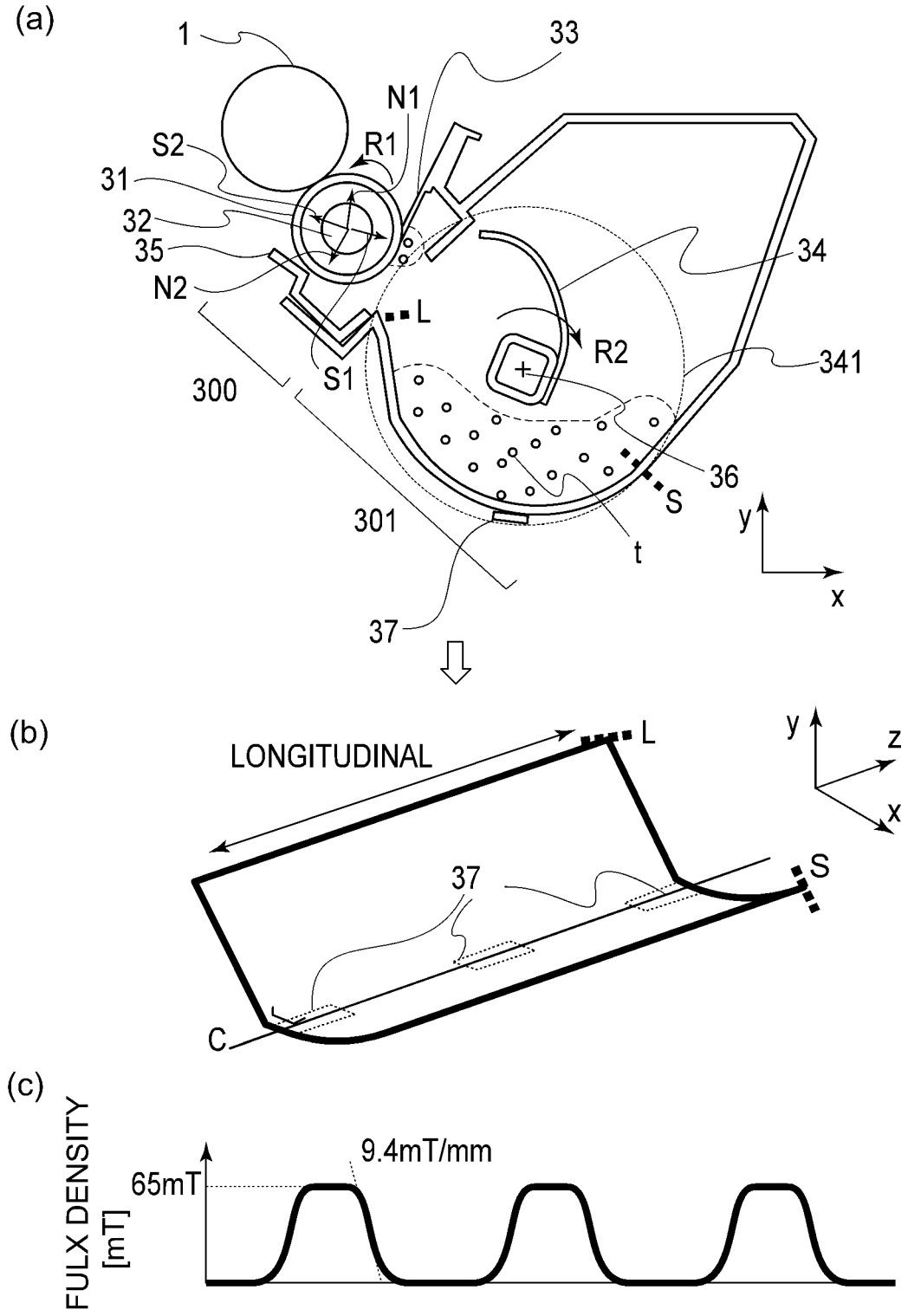

The developing device 3 in this embodiment uses a developing method of the so-called contact type, which uses magnetic toner (developer). It is structured as shown in part (a) of FIG. 1. The directions indicated by letters x and y in part (a) of FIG. 1 are the horizontal and vertical directions, respectively. These definitions apply to other drawings as well. The developing device 3 has: a developing means container 300 as a development chamber; and a toner container 301 as a developer storage chamber in which toner is stored. In other words, the developing device 3 has: the developing means container 300, which is a frame comprising the development chamber and developer storage chamber; and the toner container 301. The toner container 301 is in connection to the developing means container 300 through an opening (developmental opening). The developing means container 300 is provided with a development sleeve 31 (development roller) as a developer bearing member, and a development blade 33. The toner container 301 is provided with a stirring sheet 34 as a stirring member (stirring means).

In this embodiment, the rotational axis direction of the developer bearing member is such a direction that is parallel to the rotational axis of the development sleeve 31 (development roller). The rotational axis direction of the development sleeve 31 is such a direction that is parallel to the rotational axis of the photosensitive drum 1. Hereafter, the rotational axis direction of the developer bearing member is referred to simply as rotational axis direction. Further, the direction of the straight line which is parallel to the rotational axis of the development sleeve 31 is also referred to as rotational axis direction.

The development sleeve 31 is for developing a latent image formed on the photosensitive drum 1. It has a nonmagnetic sleeve, as a supporting portion, formed of an aluminum pipe or a stainless steel pipe. It has also an electrically conductive elastic layer which wraps around the peripheral surface of the nonmagnetic sleeve. The elastic layer is roughly 500 μm in thickness. The development sleeve 31 is supported by the developing means container 300 in such a manner that it can be rotated in the direction indicated by an arrow mark R1. The external diameter of the development sleeve 31 is roughly 11 mm. The surface roughness of the electrically conductive elastic layer is 3.0-4.0 μm in arithmetic average roughness. Referring to part (a) of FIG. 1, the development sleeve 31 remains pressed toward the photosensitive drum 1 in such a manner that its development area remains in contact with the corresponding area of the photosensitive drum 1.

The development sleeve 31 is in connection to an electric power source which makes it possible to apply DC bias to the development sleeve 31. As bias is applied to the development sleeve 31 from the electric power source, the latent image on the photosensitive drum 1 is developed into a toner image, that is, a visible image formed of toner.

The development blade 33 is a toner layer thickness regulating member which regulates the toner layer on the development sleeve 31 in thickness (amount by which toner is coated). It frictionally charges toner; it gives toner a proper amount of triboelectric charge. The development blade 33 in this embodiment is formed of urethane rubber.

The developing device 3 is provided with a magnetic roller 32 which is stationarily disposed in the internal hollow of the development sleeve 31. The magnetic roller 32 is provided with four magnetic poles, which are radially disposed as shown in the drawings. The role of Pole S2 is to keep such toner that might cause the formation of foggy images, adhered to the development sleeve 31 when toner moves onto the peripheral surface of the photosensitive drum 1 to develop the latent image on the photosensitive drum 1. Pole S1 is the opposite pole from Pole S2 relative to the axial line of the development sleeve 31 (magnetic roller 32). Pole S1 makes the toner in the developer container 301 adhere to the development sleeve 31. Poles N1 and N2 contribute to the conveyance of the toner coated on the development sleeve 31.

The lengthwise end portions of the development sleeve 31 in terms of rotational axis direction are fitted with an unshown pair of end sealing members, one for one. Each end sealing member prevents toner from leaking out of the developing means container 300, by being tightly placed in contact with the peripheral surface of the development sleeve 31. Further, the developing device 3 is provided with a development side sealing sheet 35, which extends in the rotational axis direction of the development sleeve 31. The development side sealing sheet 35 prevents toner from leaking out of the developing means container 300, by being placed in contact with the development sleeve 31. The developing means container side sealing sheet 35 is formed of such a substance as polyethylene-terephthalate.

Further, the developing device 3 is provided with a stirring shaft 36 and a stirring sheet 34, which are disposed in the developer storage chamber of the toner container 301. The stirring shaft 36 extends in the rotational axis direction. The stirring sheet 34 is flexible, and is attached to the stirring shaft 36 in such a manner that it can rotate with the stirring shaft 36. The imaginary circle 341 shown in part (a) of FIG. 1 indicates the path which the edge of the stirring sheet 34, which is parallel to the stirring shaft 36, follows if the stirring sheet 34 were allowed to remain straight.

The stirring sheet 34 is wide enough in terms of the direction perpendicular to the rotational axis direction so that it could reach beyond the bottom wall of the toner container 301. Therefore, it remains in contact with at least a part of the inward surface of the toner container 301. Further, the toner container 301 is structured so that the stirring sheet 34 loosens the toner in the toner container 301, by contacting the inward surface of the bottom wall of the toner container 301 in a manner to sweep the inward surface as if it could reach beyond the bottom wall of the toner container 301 by a preset distance. Here, the preset distance is the distance between the imaginary circle 341 and the inward surface of the bottom wall of the toner container 301, in terms of the direction perpendicular to the rotational axis direction. As the stirring sheet 34 rotates in the toner container 301, it rubs the inward surface of the bottom wall of the toner container 301. As it rubs the inward surface of the bottom wall of the toner container 301, it conveys the toner. In this embodiment, the maximum amount of the distance described above is roughly 5 mm. The toner stored in the developer storage chamber of the toner container 301 is conveyed by the stirring sheet 34, into the development chamber of the developing means container 300, through the aforementioned opening, being thereby supplied to the development sleeve 31.

As the stirring sheet 34 conveys the toner into the developing means container 300, it brings the toner attracted to the peripheral surface of the development sleeve 31 by the magnetic force from the magnetic roller 32, back into the toner container 301. That is, it actively contributes to the toner circulation in the toner container 301 and developing means container 300.

The stirring sheet 34 employed by the developing device 3 in this embodiment is formed of poly-carbonate. It is roughly 180 μm in thickness, and is roughly 220 mm in length in terms of the direction parallel to the stirring shaft 36. Further, the distance from the stirring shaft 36 to the stirring edge of the stirring sheet 34 is roughly 25 mm. The distance from the rotational axis of the stirring shaft 36 to the peripheral surface of the development sleeve 31 is roughly 24 mm. The stirring shaft 36 rotates at roughly 50 rpm, and the development sleeve 31 rotates at roughly 300 rpm. That is, the stirring sheet 34 is shaped so that its lengthwise edges are parallel to the rotational axis direction.

Referring to part (a) of FIG. 1, in this embodiment, the area of the inward surface of the bottom wall of the toner container 301 (which is equivalent to inward surface of developer storage chamber), across which the stirring sheet 34 contacts the inward surface are between Point S at which stirring sheet 34 begins to contact inward surface to Point L at which stirring sheet 34 leaves the inward surface is referred to as contact area. The aforementioned magnetic field generating means 37 which are made up of magnets attached to preset positions of the outward surface of the toner container 301, which correspond in position to the contact area. The magnetic field generating means 37 generates magnetic field across the contact area. In other words, each magnetic field generating means 37 generates a magnetic field in the toner container 301, across the area through which the stirring sheet 34 sweeps (passes). Thus, the path through which the stirring sheet 34 rotates, and the magnetic field which the magnetic field generating means 37 generates, overlap with each other. Therefore, the stirring sheet 34 comes into contact with the toner held by the magnetic field.

Part (b) of FIG. 1 is an arrangement view of the inward surface of the bottom portion of the toner container 301. In terms of the rotational axis direction (direction C, direction z), the magnetic field generating means 37 does not cover the entire area of the inward surface. It has two more sections which are disposed apart from each other in the rotational axis direction.

Each magnetic field generating means 37 used in this embodiment is in the form of a rectangular parallelepipe. It is fixed to the outward surface of the toner container 301. As for the size of each magnet of the magnetic field generating means 37, it is 2 mm in thickness, 25 mm in length in the rotational axis direction, and 5 mm in width in the direction perpendicular to both the thickness direction and rotational axis direction. In this embodiment, three magnetic generating means 37 are provided, which are aligned in the rotational axis direction. Also in terms of the rotational axis direction, there is provided a 40 mm gap between the adjacent two magnetic field generating means 37. One of the magnetic field generating means 37 is fixed to the toner container 301 so that its position corresponds to the center portion of the contact area. The other two are fixed to the lengthwise end portions of the toner container 301 in such a manner that they overlap with the lengthwise end portion of the bottom portion of the toner container 301 in terms of the rotational axis direction (part (b) of FIG. 1).

Next, the distribution of the magnetic flux density of the magnetic field generated across the contact area by the magnetic field generating means 37 in terms of the rotational axis direction is described.

The magnetic flux density was measured with the use of Gauss-Tesla meter [MS-7010] (product of F. W. Bell Co., Ltd.). It was measured along a line C in part (b) of FIG. 1, which coincides with the center of each magnetic field generating means 37. By the way, the direction of the line C is parallel to the rotational axis direction. Further, the magnetic flux density was measured at such points that are 5 mm away from the magnetic field generating means 37 toward the interior of the toner container 301, in terms of the direction perpendicular to the rotational axis direction. That is, the distance between the measuring element and magnetic field generating means 37 was set to 5 mm.

Part (c) of FIG. 1 is a graph which shows the results of the measurement of the magnetic flux density, along the line C (rotational axis direction). The vertical axis of part (c) of FIG. 1 indicates the magnetic flux density measured at each point of measurement.

Here, a curved line which shows the relationship between points at which the magnetic flux density is measured, and the magnetic flux density is referred to as magnetic flux density distribution curve. Part (c) of FIG. 1 shows the magnetic flux density distribution along the line C. Hereafter, "magnetic flux density distribution" means the magnetic flux density distribution which resulted as magnetic flux density was measured along the line C.

Since the magnetic field generating means 37 are positioned as described above, the toner container 301 is not uniform in magnetic flux density in terms of the rotational axis direction, as shown in part (c) of FIG. 1. That is, the adjacencies of the bottom wall of the toner container 301 have such portions that are highest in magnetic flux density, and such portions that are lowest in magnetic flux density, in terms of the rotational axis direction. That is, the contact area has the first areas (positions) which are highest in magnetic flux density, and the second areas which are lowest in magnetic flux density. In other words, the bottom portion of the toner container 301 has portions across which magnetic flux density gradually increases (or decreases) in terms of the rotational axis direction. By the way, in terms of the rotational axis direction, the portions of the contact area, which are the highest in magnetic flux density, overlap with the positions of the magnetic field generating means 37, and the portions of the contact area, which are the lowest in magnetic flux density, overlap with the positions of the gaps between the adjacent two magnetic field generating means 37.

In this embodiment, the highest magnetic flux density is 65 mT, and the lowest magnetic flux density is 0.3 mT. The highest inclination (ratio of change in magnetic flux density relative to change in position in line C direction) of slanted portion is 9.4 [mT/mm] as shown in part (c) of FIG. 1. In terms of rotation axis direction, the contact area is not uniform in magnetic flux density, and the solid line in part (c) of FIG. 1, which represents the magnetic flux density has peaks, valleys, and slanted portions, as described above. This phenomenon is expressed as "magnetic flux density distribution has highest magnetic density points".

(Effects of Toner Circulation by Magnetic Field Generating Means)

Next, the effects of the toner circulation in the rotational axis direction caused by the nonuniformity in the magnetic flux density of the magnetic field generating means 37 is described in detail. In terms of the rotational axis direction, the toner in the developing device 3 is not uniform in the state of deterioration, because how toner deteriorates is affected by how toner is consumed by printing, development blade 33, and/or contact pressure between the photosensitive drum 1 and toner. Further, in the case of the developing device 3 in this embodiment, which is structured so that toner is stirred by the stirring sheet 34, toner is less likely to move in the rotational axis direction which is perpendicular to the rotational direction of the stirring sheet 34 than in the rotational direction.

Therefore, the toner in certain portions of the toner container 301 in terms of the rotational axis direction is deteriorated faster than that in the other portions. As the toner in a certain portion of the toner container 301 is deteriorated faster than that in the other portion, such an image defect as "fog" sometimes occurs. In this embodiment, however, the developing device 3 is provided with the magnetic field generating means 37 for promoting toner movement in the rotational axis direction. Therefore, it is possible to prevent the occurrence of the image defects described above.

Hereafter, this mechanism is described with reference to FIGS. 3-6. As the flexible stirring sheet 34 moves on the inward surface of the toner container 301 while being flexed by the bottom wall of the toner container 301, the toner on the inward surface of the toner container 301 is scraped away by the stirring sheet 34, across the area which includes the area which is affected in magnetic flux density by the magnetic field generating means 37. In a case where the toner container 301 has a substantial amount of toner, as the stirring sheet 34 rotates, the toner returns to the magnetic field generating means 37 through the path indicated by an arrow mark A in part (a) of FIG. 3. In a case where the toner container 301 contains only a small amount of toner, the toner returns to the magnetic field generating means 37 through the path indicated by an arrow mark B. That is, in a case where the toner container 301 contains a substantial amount of toner, as the stirring sheet 34 rotates, the toner which is in the areas which correspond in position to the magnetic field generating means 37 is removed by the stirring sheet 34, and then, the toner which is in the adjacencies of the areas which correspond in position to the magnetic field generating means 37 flows into the areas which correspond in position to the magnetic field generating means 37. In a case where the toner container 301 contains only a small amount of toner, as the stirring sheet 34 rotates, the toner which is in the areas which correspond in position to the magnetic field generating means 37 is removed by the stirring sheet 34, and then, the vacated areas, or the areas which correspond in position to the magnetic field generating means 37, and from which toner has just been removed, remain toner-free for a while. Then, the toner which has remained adhering to the stirring sheet 34 falls, and is conveyed by the stirring sheet 34. Thus, the areas which correspond in position to the magnetic field generating means 37 is supplied with the toner which has just fallen from the stirring sheet 34.

If the magnetic flux density distribution of the toner container 301 is such that, in terms of the rotational axis direction, certain portions of the bottom portion of the toner container 301 have the highest value in magnetic flux density as shown in part (c1) of FIG. 1, there is inclination in magnetic flux density, in the toner container 301. Therefore, the toner in the toner container 301 is subjected to such magnetic force that acts in the rotational axis direction. If the inclination of the magnetic flux density is substantial, the toner is moved in the rotational axis direction by this magnetic force, as shown in part (a) of FIG. 4.

That is, as the toner is moved closer to the magnetic field generating means 37 by the rotating stirring sheet 34, it moves in a manner to converge to the magnetic field generating means 37 in the rotational axis direction as shown in part (a) of FIG. 4. A part of this toner flows into the area between the adjacent two magnetic field generating means 37 in terms of the rotational axis direction.

By the way, the magnetic flux density inclination, which is necessary to move the toner in the rotational axis direction is set in consideration of the effects of such factors as the magnetic substance content of the toner, toner particle diameter, and attraction between the toner and the inward wall of the toner container 301.

In the case of an example of a comparative developing device, the amount by which the toner moves in the direction perpendicular to the rotational direction of the stirring sheet 34 is rather small, although the toner moves in the rotational direction of the stirring sheet 34 as shown in part (b) of FIG. 4.

Further, in the case of this embodiment, even if the toner returns through the path indicated by an arrow mark V, which is opposite in direction from the rotational direction of the stirring sheet 34, which is indicated by an arrow mark R2 as shown in FIG. 5, the presence of the magnetic field generating means 37 can move the toner in the rotational axis direction as shown in FIG. 6.

That is, in a case where the returned toner approaches the magnetic field generating means 37 in the direction parallel to the rotational direction of the stirring sheet 34, the toner moves in such a manner that it converges to the magnetic field generating means 37 in the rotational axis direction as shown in FIG. 6. That is, a part of the returned toner moves into the area between the adjacent two magnetic field generating means 37, in the direction parallel to the rotational axis of the developer bearing member.

Even if the toner container 301 is in such a condition that areas having a larger amount of toner, and areas having a smaller amount of toner, are alternately present in the rotational axis direction, as the toner is stirred by the stirring sheet 34, the toner layer is leveled to a certain degree, because toner is more likely to flow into the areas having a smaller amount of toner than the areas having a smaller amount of toner. Thus, as the stirring sheet 34 is rotated, the toner container 301 is changed in state from the one in which a part of the body of toner in the toner container 301 is collected by the magnetic field generating means 37, into one in which the toner is roughly evenly distributed in the toner container 301 in terms of the rotational axis direction.

By causing the developing device 3 to repeat the cycle described above, it is possible to cause the toner in the toner container 301 to circulate in the rotational axis direction, and therefore, it is possible to prevent the occurrence of the image defects attributable to the toner deterioration which locally occurs in terms of the rotational axis direction.

Table 1 shows the results of a comparison between the comparative developing device (3) which is not provided with the magnetic field generating means 37, and the developing device 3 in this embodiment of the present invention, which is provided with the magnetic field generating means 37, in image evaluation in terms of the amount of "fog" on a sheet of recording medium, more specifically, the value obtained by dividing the fog (toner) density on the theoretically toner-free portions of an image, by the toner density (100%) of a black color calibration sheet (board).

In the case of the comparative developing device, toner deterioration occurred across the lengthwise end portions of the interface between the photosensitive drum 1 and development sleeve 31, which are relatively high in contact pressure. Thus, foggy images were generated as the developing device comes close to the end of its life span. In comparison, the developing device 3 in this embodiment was provided with magnetic field generating means 37, which were distributed as described above. Therefore, the toner deterioration and the resultant fog generation were prevented (minimized).

Regarding the fog evaluation in Table 1, "○" indicates that the fog ratio is in a range of 0-3%; Δ, 3-4%, and "X" indicates that the fog ratio is in a range of no less than 4%. In the case of the comparative developing device, the fog evaluation is "Δ", as the cumulative number of image formation reaches 6,000. As the cumulative number of image formation became 8,000, the evaluation falls to "X". In the case of the developing device 3 in this embodiment, however, the fog evaluation does not become "X" until the cumulative number of image formation exceeded 8,000.

TABLE 1

| | | No. of processed sheets | | | |
|---|---|---|---|---|---|
| | | 5000 | 6000 | 7000 | 8000 |
| Fog on sheet | Comp. Ex. | ○ | Δ | Δ | X |
| | Emb. 1 | ○ | ○ | ○ | Δ |

Further, in addition to the points made above, according to this embodiment, it is possible to prevent the problems that an image forming apparatus outputs an image which suffers from nonuniformity in density in terms of the rotational axis direction, which is attributable to local toner deterioration in terms of the rotational axis direction, and also, that toner becomes welded to the development blade 33 and photosensitive drum 1.

Embodiment 2

Next, the second embodiment of the present invention is described. In the second embodiment, magnetic field generating means such as the magnetic field generating means 37 in the first embodiment are better positioned from the standpoint of their effectiveness.

In this embodiment, the magnetic field generating means 37 are positioned so that a magnetic field is generated on the slanted surface in the contact area, the angle α of which relative to the horizontal surface, as seen from the rotational axis direction, is no less than the angel of rest, and no more than 90°. "Angle of rest" of toner is such an angle that as toner is accumulated in the form of a cone, for example, on a horizontal surface, the toner particles slide down on the surface of the cone due to their own weight. In this embodiment, the angle of rest of the toner was 60°, and the magnetic field generating means 37 were positioned so that magnetic field is generated on the area in which the angle α of the slanted surface becomes 65° which is greater than the angle of rest of the toner. By the way, the angle of the above-described slanted surface is the angle between the slanted surface and the horizontal surface when the stirring sheet 34 is rotating (during image formation, for example).

Hereafter, the effects of toner circulation in this embodiment is described. Like in the first embodiment, the developing device 3 is provided with two or more magnetic field generating means 37, which are evenly distributed on the outward surface of the toner container 301, in the rotational axis direction, in such a manner that the magnetic field generating means 37 generate magnetic field, on the inward surface of the toner container 301. The magnetic flux density distribution of the generated magnetic flux density distribution has the areas which are highest in magnetic flux density and the areas which are lowest in the magnetic flux density as in the first embodiment.

The highest value of the magnetic flux density of this magnetic field generating means 37 is set (65 mT in this embodiment) so that the toner attracted to the magnetic field generating means 37 from the top side of the toner container 301 does not fall off from the magnetic field generating means 37 because of its own weight; it is held by the magnetic field generating means 37.

In terms of the rotational axis direction, the three magnetic field generating means 37 which are evenly distributed in the rotational axis direction, and generate areas which are highest in magnetic flux density, areas which are lowest in magnetic flux density, and transitional areas between an area which is highest in magnetic flux density and the adjacent area which is lowest in magnetic flux density. On the area between the adjacent two magnetic field generating means 37, the toner on the inward surface of the toner container 301 slide down because of its own weight. That is, the developing device 3 is adjusted in the interval between the adjacent two magnetic field generating means 37, and the lowest value of the magnetic flux density inclination is set so that the toner on the inward surface of the toner container 301, which corresponds in position to the transitional area slides down because of its own weight.

In this embodiment, in order to adjust the lowest value of the magnetic flux density to 0.3 mT, the height value of the magnetic flux density was set to 65 mT, and the interval between the adjacent two magnetic field generating means 37 was set to 40 mm. The highest magnetic density which is necessary to hold toner, and lowest magnetic density which is necessary to allow toner to slide down because of its own weight, are set in consideration of the magnetic substance content of toner, toner particle diameter, attraction between toner and the inward surface of the toner container 301, value of the angle α, etc. For example, the highest magnetic flux density and the lowest magnetic flux density can be set by observing whether or not toner actually slides down because of its own weight while changing magnetic field generating means 37 in magnetic flux density.

In the case of the developing device 3 in this embodiment, which was structured as described above, when a sufficient amount of toner remains in the toner container 301, and the top surface of the body of toner in the toner container 301 is always higher than the portion of the inward surface of the toner container 301, which corresponds in position to the portion of the outward surface of the toner container 301, which has the magnetic field generating means 37, toner is circulated as effectively as in the first embodiment.

On the other hand, in a case where the toner container 301 contains only a small amount of toner, and the top surface of the body of toner in the toner container 301 is lower than the portion of the inward surface of the toner container 301, which corresponds to the portion of the outward surface of the toner container 301, and having the magnetic field generating means 37, toner is circulated in the pattern which is specific to this embodiment.

That is, referring to part (a) of FIG. 7, the portion of the inward wall of the toner container 301, which corresponds in position to the magnetic field generating means 37, has an angle α, which is no less than the angle of the rest of toner. Therefore, the toner moves through a path indicated by an arrow mark V. As the toner moves, the toner is attracted to the inward surface of the toner container 301 by the magnetic force from the magnetic field generating means 37, as shown in part (b) of FIG. 7. Shown in part (a) of FIG. 8 is the state of the toner attracted to the inward surface of the toner container 301 by the magnetic field generating means 37.

The highest density for the magnetic flux from the magnetic field generating means 37 is set so that the toner does not slide down because of its own weight. Therefore, as the toner slides down on the inward surface of the toner container 301 from the top side of each magnetic field generating means 37, it is retained on the portion of the inward surface of the toner container 301 (surrounded by dotted line in part (a) of FIG. 8), which includes the portion which is highest in magnetic flux density. However, the toner container 301 is structured so that in the adjacencies (area between adjacent two magnetic field generating means 37) of the portion which is lowest in magnetic flux density, the toner slides down because of its own weight. Therefore, the toner is not retained on these portions (part (a) of FIG. 8). That is, referring to part (a) of FIG. 8, there is virtually no toner between the adjacent two magnetic field generating means 37 in terms of the rotational axis direction. That is, the toner container 301 in this embodiment is small in the amount of toner between the adjacent two magnetic field generating means 37 than the one in the first embodiment.

As the rotating stirring sheet 34 returns to where the magnetic field generating means 37 are while the toner container 301 is in the state described above, the toner (part (a) of FIG. 8) which has been held by the magnetic force from the magnetic field generating means 37 is loosened. Then, the toner moves in such a manner that the farther it is from the magnetic field generating means 37, the wider the toner disperses in the rotational axis direction, as shown in part (b) of FIG. 8. That is, the toner held by the magnetic field generating means 37 is likely to flow into the areas (between adjacent two magnetic field generating means 37) having a smaller amount of toner.

The toner container 301 in the first embodiment was structured so that a substantial amount of toner was present between the adjacent two magnetic field generating means 37. It was unlikely for the toner retained by the magnetic field generating means 37, to flow into the areas between the adjacent two magnetic field generating means 37. In comparison, the toner container 301 in this embodiment is structured so that it is substantially smaller in the amount of toner between the adjacent two magnetic field generating means 37. Therefore, it is more likely for the toner held by the magnetic field generating means 37, to flow into the areas between the adjacent two magnetic field generating means 37 as described above.

In this embodiment, in a case where only a small amount of toner remains in the toner container 301, the repetition of the above-described cycle causes the toner to circulate in the rotational axis direction (part (a) of FIGS. 4 and 6(*a*)) as in the first embodiment. In addition, the toner is loosed by the stirring sheet 34 (part (b) of FIG. 8). Therefore, this embodiment was able to more effectively circulate the toner by the magnetic field generating means 37. Therefore, it can more effectively prevent the problem that an image forming apparatus tends to output foggy images due to toner deterioration, toward the end of service life of the developing device 3.

Also in this embodiment, in a case where there is a substantial amount of toner in the toner container 301, the toner is just as effectively circulated as in the first embodiment (part (a) of FIGS. 4 and 6(*a*)).

Shown in Table 2 are the results of the comparison among the comparative example of toner container 301, that is, a conventional toner container 301, which does not have the magnetic field generating means 37 described above, the toner container 301 in the first embodiment, and the one in this embodiment, in terms of the fog evaluation. The second embodiment is much better than the first embodiment, in terms of fog evaluation.

TABLE 2

| | | No. of processed sheets | | | |
|---|---|---|---|---|---|
| | | 5000 | 6000 | 7000 | 8000 |
| Fog on sheet | Comp. Ex. | ○ | Δ | Δ | X |
| | Emb. 1 | ○ | ○ | ○ | Δ |
| | Emb. 2 | ○ | ○ | ○ | ○ |

(Modified Versions)

In the foregoing, the preferred embodiments of the present invention were described. However, the preceding embodiments are not intended to limit the present invention in scope. That is, the present invention is also applicable to various modified versions of the image forming apparatus (developing device 3; toner container 301) within its scope.

(Modification 1)

In the preceding embodiment described above, the toner container 301 was provided with three magnetic field generating means 37, which were evenly distributed in the rotational axis direction with the provision of preset intervals. However, the preceding embodiments are not intended to limit the present invention in terms of the number of magnetic field generating means 37. That is, the present invention is also applicable to a toner container 301 having only one magnetic field generating means 37, two, or four or more magnetic field generating means 37. By the way, as the toner container 301 is increased in the number of the magnetic field generating means 37 distributed in the rotational axis direction, the toner container 301 increases in the number of areas in which the line which indicates the magnetic flux density has inclination as shown in part (c1) of FIG. 1. Thus, the toner container 301 may be provided with three or more magnetic field generating means 37 which are evenly distributed in the rotational axis direction.

Further, the greater the toner container 301 in the gradient of the line in part (a) of FIG. 9, which indicates the magnetic flux density distribution in the toner container 301, the more preferable the toner container 301 is. Therefore, the greater a magnet is in magnetic force, the more preferable it is as the material for the magnetic field generating means 37.

(Modification 2)

In the preceding embodiments described above, the toner container 301 was provided with a single row of two or more magnetic field generating means 37 distributed with equal intervals in the rotational axis direction. These embodiments, however, are not intended to limit the present invention in scope. That is, the toner container 301 may be provided with two or more rows of magnetic field generating means 37, which are parallel to the rotational direction of the stirring sheet 34, as shown in part (a) of FIG. 9. Further, the toner container 301 may be provided with two or more magnetic field generating means 37, which are positioned so that one or more of the magnetic field generating means 37 are positioned so that they are different in position from the other magnetic field generating means 37 in terms of the rotational direction of the stirring sheet 34, as shown in part (b) of FIG. 9.

(Modification 3)

As long as the magnetic field generating means 37 are allowed to generate magnetic field in the toner container 301, they do not need to be on the outward surface of the toner container 301. That is, the magnetic field generating means 37 may be placed on the inward surface of the toner container 301, or in the recesses, with which the inward surface of the toner container 301 is provided. Further, the magnetic field generating means 37 may be implanted between the inward and outward surfaces of the toner container 301. That is, the toner container 301 may be structured so that the magnetic field generating means 37 are placed on the preset portions of the inward surface of the toner container 301, with which the stirring sheet 34 comes into contact.

In a case where the inward surface of the toner container 301 is provided with the magnetic field generating means 37, the magnetic field generating means 37 may be less in magnetic force. However, in a case where the step between the inward surface of the toner container 301 and the magnetic field generating means 37 is substantial in height, the toner collects in the adjacencies of the step. Therefore, the toner container 301 has to be constructed so that the step is as low as possible. On the other hand, as long as the magnetic field generating means 37 is attached to the outward surface of the toner container 301, there will be no steps attributable to the presence of the magnetic field generating means 37. However, in a case where the magnetic field generating means 37 are attached to the outward surface of the toner container 301, they have to be stronger in magnetic force than those which are attached to the inward surface of the toner container 301.

Further, not only may the magnetic field generating means 37 be attached to the developing device 3, more specifically, the portions of the inward surface of the developer storage chamber (toner container 301), with which the stirring sheet 34 comes into contact as it is rotated, but also, to the main assembly of the image forming apparatus. That is, it is not important to what portions of the image forming apparatus the magnetic field generating means 37 are to be attached as long as the image forming apparatus (toner container 301) is constructed so that the magnetic field generated across the contact area in the toner container 301 is nonuniform in magnetic flux density in terms of the rotational axis direction.

(Modification 4)

Further, in the preceding embodiments, a developing method of the so-called contact type was used. However, the preceding embodiments are not intended to limit the present invention in terms of developing method. That is, the present invention is also compatible with a developing method of the so-called non-contact type, because as long as magnetic toner is used, the present invention can cause the toner in the toner container 301 to circulate in the rotational axis direction. A non-contact developing device can prevent the problem that an image forming apparatus tends to output such images that are foggy and/or nonuniform in density across the portions which correspond in position to the areas in which the contact pressure between a development blade and a development sleeve is relatively high.

Further, in the preceding embodiments, the developing devices were in the form of a cassette which is removably installable in the main assembly of an image forming apparatus. However, the present invention is also applicable to a developing device which is fixed to the main assembly of an image forming apparatus. Further, the present invention is also applicable to a cartridge (so-called process cartridge) which contains not only a developing device, but also, an image bearing member (photosensitive drum) which opposes the development area of a developer bearing member.

Effects of Invention

According to the present invention, it is possible to provide a developing device, an image forming apparatus, and a cartridge, which can prevent the occurrence of image defects attributable to the nonuniformity, in the deterioration of developer which contains magnetic substance, in terms of the rotational axis direction of the developer bearing member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-075986 filed on Apr. 11, 2018, which is hereby incorporated by reference herein in its entirety.

What is claimed is:

1. A developing device comprising:

a rotatable developer carrying member configured to carry a developer comprising a magnetic material to develop a latent image formed on an image bearing member;

a developer accommodating chamber configured to accommodate the developer to be supplied to said developer carrying member;

a rotatable stirring member provided inside said developer accommodating chamber and configured to stir the developer while being in contact with at least a part of an inner surface of said developer accommodating chamber; and a plurality of magnetic field generating members generating a magnetic field in at least a part of a contact region where said stirring member contacts said inner surface, wherein the plurality of the magnetic field generating members is disposed such that a magnetic flux density of the magnetic field at a first position in the contact region is different from a magnetic flux density of the magnetic field at a second position in the contact region, and a magnetic flux density of the magnetic field at a third position in the contact region is different from a magnetic flux density of the magnetic field at a fourth position in the contact region, and wherein the second position is adjacent to the first position in a rotational axis direction of said developer carrying member, and the fourth position is adjacent to the third position in the rotational axis direction.

2. A device according to claim 1, wherein said stirring member includes a sheet-like member having a length measured in the rotational axis direction larger than that measured in a direction crossing with the rotational axis direction.

3. A device according to claim 1, wherein the plurality of magnetic field generating members includes a first magnetic field generating member and a second magnetic field generating member, and wherein a position of the first magnetic field generating member is different from a position of the second magnetic field generating member with respect to the rotational axis direction.

4. A device according to claim 3, wherein the first magnetic field generating member is disposed spaced from the second magnetic field generating member.

5. A device according to claim 4, wherein the first magnetic field generating member is disposed at a position overlapping with a central portion of the contact region with respect to the rotational axis direction, and the second magnetic field generating member is disposed at a position overlapping with an end portion of the contact region with respect to the rotational axis direction.

6. A device according to claim 1, wherein the plurality of magnetic field generating members includes a first magnetic field generating member and a second magnetic field generating member, and wherein a position of the first magnetic field generating member is different from a position of the second magnetic field generating member with respect to a rotational moving direction of said stirring member.

7. A device according to claim 1, wherein the plurality of magnetic field generating members is disposed such that the magnetic field is generated at an inclined surface in the contact region, the inclined surface being inclined relative to a horizontal plane by an angle not less than an angle of the rest of the developer.

8. A device according to claim 1, wherein the magnetic flux density at the first position is larger than the magnetic flux density at the second position such that the developer is moved toward the first position from the second position with respect to the rotational axis direction, and the magnetic flux density at the third position is larger than the magnetic flux density at the fourth position such that the developer is moved toward the third position from the fourth position with respect to the rotational axis direction.

9. An image forming apparatus comprising:

a developing device;

a rotatable developer carrying member configured to carry a developer comprising a magnetic material to develop a latent image formed on an image bearing member;

a developer accommodating chamber configured to accommodate the developer to be supplied to said developer carrying member;

a rotatable stirring member provided inside said developer accommodating chamber and configured to stir the developer while being in contact with at least a part of an inner surface of said developer accommodating chamber; and a plurality of magnetic field generating members generating a magnetic field in at least a part of a contact region where said stirring member contacts said inner surface, wherein the plurality of magnetic field generating members is disposed such that a magnetic flux density of the magnetic field at a first position in the contact region is different from a magnetic flux density of the magnetic field at a second position in the contact region, and a magnetic flux density of the magnetic field at a third position in the contact region is different from a magnetic flux density of the magnetic field at a fourth position in the contact region, and wherein the second position is adjacent to the first position in a rotational axis direction of said developer carrying member, and the fourth position is adjacent to the third position in the rotational axis direction.

10. An apparatus according to claim 9, wherein the plurality of magnetic field generating members includes a first magnetic field generating member and a second magnetic field generating member, and wherein a position of the first magnetic field generating member is different from a position of the second magnetic field generating member with respect to the rotational axis direction.

11. An apparatus according to claim 10, wherein the first magnetic field generating member is disposed spaced from the second magnetic field generating member.

12. An apparatus according to claim 9, wherein the plurality of magnetic field generating members is disposed such that the magnetic field is generated at an inclined surface in the contact region, the inclined surface being inclined relative to a horizontal plane by an angle not less than an angle of the rest of the developer.

13. An apparatus according to claim 9, wherein the magnetic flux density at the first position is larger than the magnetic flux density at the second position such that the developer is moved toward the first position from the second position with respect to the rotational axis direction, and the magnetic flux density at the third position is larger than the magnetic flux density at the fourth position such that the developer is moved toward the third position from the fourth position with respect to the rotational axis direction.

14. A cartridge detachably mountable to a main assembly of an image forming apparatus, said cartridge comprising:

a rotatable developer carrying member configured to carry a developer comprising a magnetic material to develop a latent image formed on an image bearing member;

a developer accommodating chamber configured to accommodate the developer to be supplied to said developer carrying member;

a rotatable stirring member provided inside said developer accommodating chamber configured to stir the developer while being in contact with at least a part of an inner surface of said developer accommodating chamber; and a plurality of magnetic field generating members generating a magnetic field in at least a part of a contact region where said stirring member contacts said inner surface, wherein the plurality of magnetic field generating members are disposed such that a magnetic flux density of the magnetic field at a first position in the contact region is different from a magnetic flux density of the magnetic field at a second position in the contact region, and a magnetic flux density of the magnetic field at a third position in the contact region is different from a magnetic flux density of the magnetic field at a fourth position in the contact region, and wherein the second position is adjacent to the first position in a rotational axis direction of said developer carrying member, and the fourth position is adjacent to the third position in the rotational axis direction.

15. A cartridge according to claim 14, wherein the plurality of magnetic field generating members including a first magnetic field generating member and a second magnetic field generating member, and wherein a position of the first magnetic field generating member is different from a position of the second magnetic field generating member with respect to the rotational axis direction.

16. A cartridge according to claim 15, wherein the first magnetic field generating member is disposed spaced from the second magnetic field generating member.

17. A cartridge according to claim 16, wherein the first magnetic field generating member is disposed at a position overlapping with a central portion of the contact region with respect to the rotational axis direction, and the second magnetic field generating member is disposed at a position overlapping with an end portion of the contact region with respect to the rotational axis direction.

18. A cartridge according to claim 14, wherein the plurality of magnetic field generating members is disposed such that the magnetic field is generated at an inclined surface in the contact region, the inclined surface being inclined relative to a horizontal plane by an angle not less than an angle of the rest of the developer.

19. An cartridge according to claim 14, further comprising the image bearing member disposed opposed to said developer carrying member.

20. A cartridge according to claim 14, wherein the magnetic flux density at the first position is larger than the magnetic flux density at the second position such that the developer is moved toward the first position from the second position with respect to the rotational axis direction, and the magnetic flux density at the third position is larger than the magnetic flux density at the fourth position such that the developer is moved toward the third position from the fourth position with respect to the rotational axis direction.

* * * * *